United States Patent [19]

Bowen

[11] 3,950,056

[45] Apr. 13, 1976

[54] RELEASABLE RETENTION MEANS FOR ELECTRICAL CONTACTS IN A CONNECTOR

[76] Inventor: Roger Bowen, 118 Patrician Way, Pasadena, Calif. 91105

[22] Filed: Aug. 26, 1974

[21] Appl. No.: 500,540

[52] U.S. Cl. ..... 339/59 M

[51] Int. Cl.[2] ..... H01R 13/40

[58] Field of Search ..... 339/59–61, 339/217

[56] References Cited

UNITED STATES PATENTS

| | | | |
|---|---|---|---|
| 3,165,369 | 1/1965 | Maston | 339/59 M |
| 3,835,442 | 9/1974 | Anderson et al. | 339/59 R |
| 3,838,382 | 9/1974 | Sugar | 339/59 R |

*Primary Examiner*—Joseph H. McGlynn
*Attorney, Agent, or Firm*—Huebner & Worrel

[57] ABSTRACT

An electrical connector having an insulator member with bores therethrough from a forward face to a rearward face each adapted to receive electrical contacts from the rear, the electrical contacts having a rearwardly facing retaining surface, and releasable retention means associated with the rearward face of the insulator member for engaging the rearwardly facing retaining surface of the contacts to releasably retain the electrical contacts in the insulator member; and in which the amount of space required between the electrical contacts in the bores is no greater than the insulation thickness requirement, there being no additional space required by the retention means.

14 Claims, 11 Drawing Figures

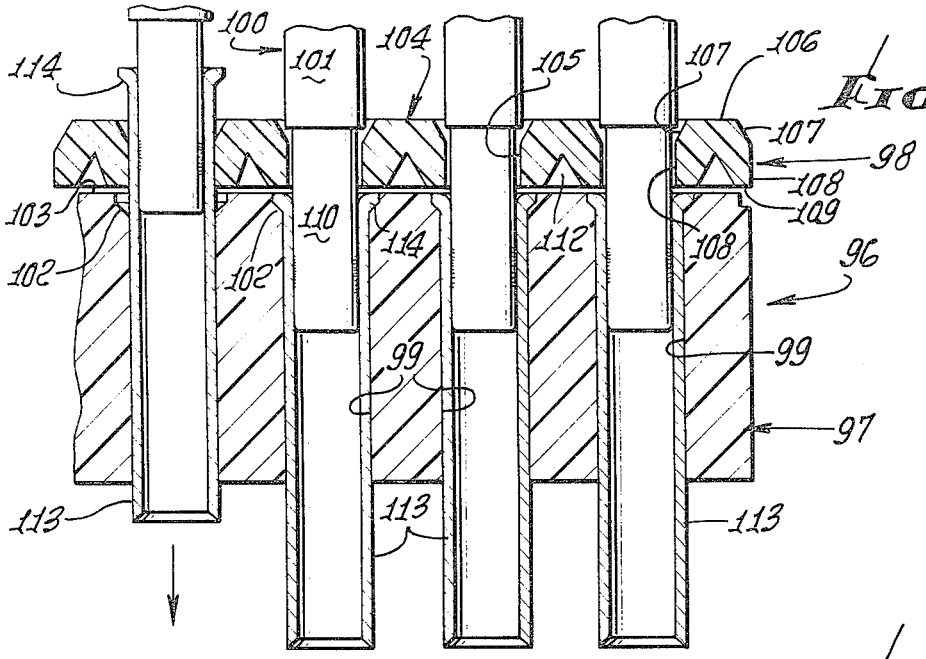
FIG. 8.
FIG. 10.
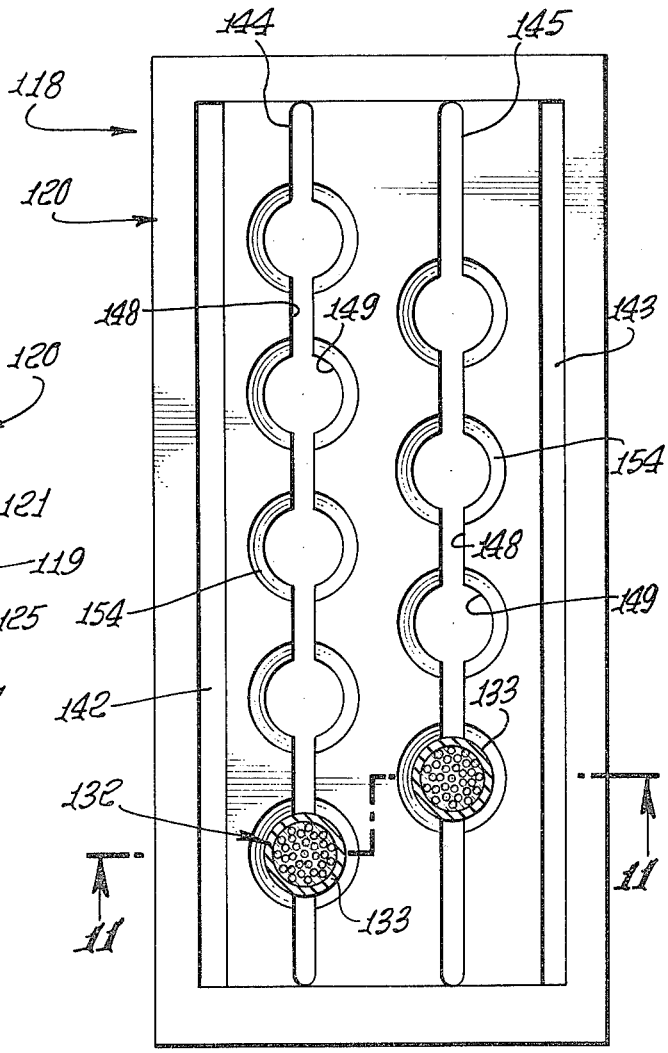
FIG. 11.
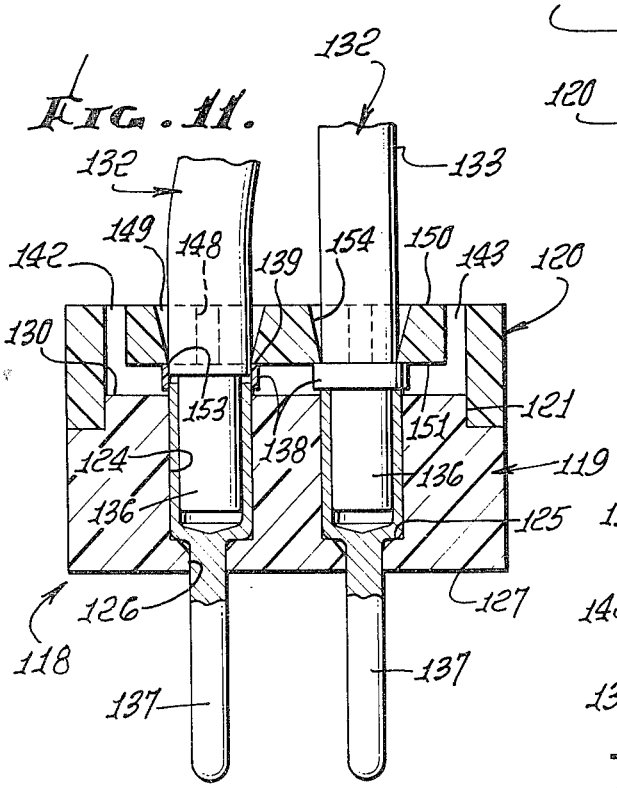

RELEASABLE RETENTION MEANS FOR ELECTRICAL CONTACTS IN A CONNECTOR

BACKGROUND OF THE INVENTION

The present invention relates to electrical connectors of the type having a plurality of contacts in one connector member which are matable with a plurality of contacts in another connector member. More particularly, the invention relates to releasable retention means in the connectors for permitting the electrical contacts to be inserted into and removed from their operative positions in respective bores in the insulators of the connectors, the retention means being operable by a suitable tool.

In the prior art the electrical contact release systems that utilize a tool to insert and to remove the contacts from the connector require space around the contacts for the retention devices and for the tool to go into the bore around the wire and release the contacts. U.S. Pat. Nos. 3,165,369 and 3,158,424 illustrate such retention means. Specifically, these patents show the space required by an enlarged holding shoulder on the electrical contacts, a tool to enter the bore and open the contact holding devices, and the thickness of the holding devices.

In miniature and ultraminiature connectors the space between the electrical contacts in the bores is determined by the insulation thickness requirements between the bores plus any other space considerations around the bores, as for example in the prior art the space requirements for the retention means.

In general, there is at least a requirement of 0.010 inch for electrical insulation between any two contacts. Considering, a holding shoulder on an electrical contact to be a minimum of 0.005 inch and a contact retention device to have a minimum thickness of about 0.003 inch, these two add 0.016 inch (0.008 inch on each side) to the diameter of the bore in the insulator. This means that a contact insertion and release tool must be limited in wall thickness to 0.004 inch so that it will fit in the space between the device and the cylindrical surface on the shoulder forming member of the contact. Using such a prior art arrangement with a special retaining shoulder of 0.005 inch aand retaining tyne of 0.003 inch, the space distance between the contacts is enlarged by 0.016inch minimum over that required by this invention. In miniature and ultraminiature connectors, where the wire insulation is generally larger than the contact, such an increase in space requirement between the electrical contacts presents serious space problems.

SUMMARY OF THE INVENTION

The present invention eliminates the requirement of space between the electrical contacts in addition to that required for insulation purposes. This is made possible by releasable retention devices which do not operate in the bores or coaxially in extensions thereof but operate transversely with respect to the bores so as to be movable to overlap portions of the bores and so as to be withdrawable from the overlapping positions. Further, the need to employ a tool coaxially with respect to a bore or an extension thereof as with the prior art retention means is eliminated by the present invention.

Accordingly, it is an object of the present invention to provide an improved releasable retention system for any electrical contacts having a rearwardly facing shoulder within electrical connectors. The electrical contacts may be cylindrical, rectangular or leaf and in some situations the retention means need be in the way of or removal path of only one small portion of the shoulder and not on two sides of the electrical contact as generally shown herein.

It is another object of the invention to provide a releasable retention system for electrical contacts within a connector whereby a plurality of electrical contacts are releasably retained in the connector without the provision of a space requirement between the contacts for the retention device in addition to the space required for insulation between the contacts.

It is still another object of the invention to provide means for releasably retaining electrical contact members in an electrical connector in which the retention is applied to the largest outside diameter of the electrical contact or wire termination, whichever is the greater, in the immediate area of the rear of the electrical contact, without increasing the required insulation space between the contacts; that is, wherever there is an adaptable surface or a protrusion whether it be the wall of the electrical contact, a contact protrusion necessary for preventing forward movement of the contact or an added protrusion used to couple the wire to the contact, such as tape around the contact or an ear on the contact formed by crimping or an accessory as an insulation retaining contact sleeve, the retention means may be applied and a special retaining shoulder is not required.

It is a further object of the invention to provide an electrical contact retention system that permits rear insertion and removal of the contacts from the connector by first opening the retention device and then placing the electrical contact into the bore in the connector or removing it therefrom without use of force.

It is a still further object of the invention to provide releasable retention means for electrical contacts in a connector in which a tool to release the retention means may be inserted adjacent to the contacts and without going around the wire.

It is another object of the invention, as set forth in the preceding paragraphs, to include the ability to control the amount of retaining force provided, such as, higher retention forces for large contacts and smaller retention forces for small contacts. This is accomplished by controlling the cross-sectional area and shape of the retention device at its junction with the side walls and/or the immediate area of the contact where the retention is provided.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 8 is a fragmentary elevational view illustrating another embodiment of the invention;

FIG. 10 is a plan view of still another embodiment of the invention; and

FIG. 11 is an elevational cross-sectional view taken along the lines 11—11 of FIG. 10.

DESCRIPTION OF THE PREFERRED EMBODIMENTS

Figure 1:
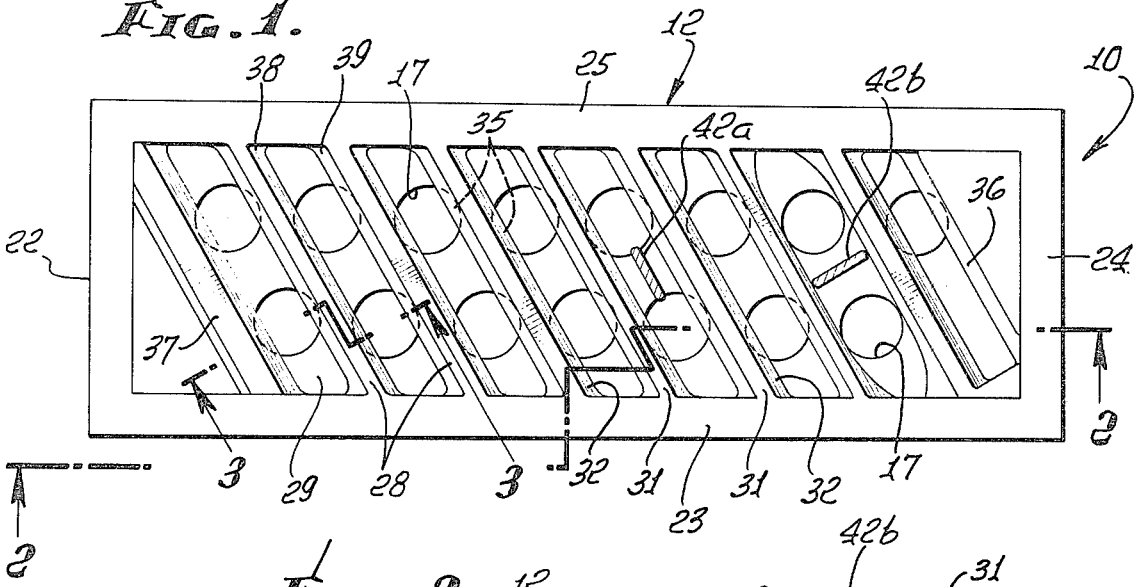
FIG. 1 is a plan view of an electrical connector having one embodiment of a releasable retention means for electrical contacts according to the invention.
Figure 2:
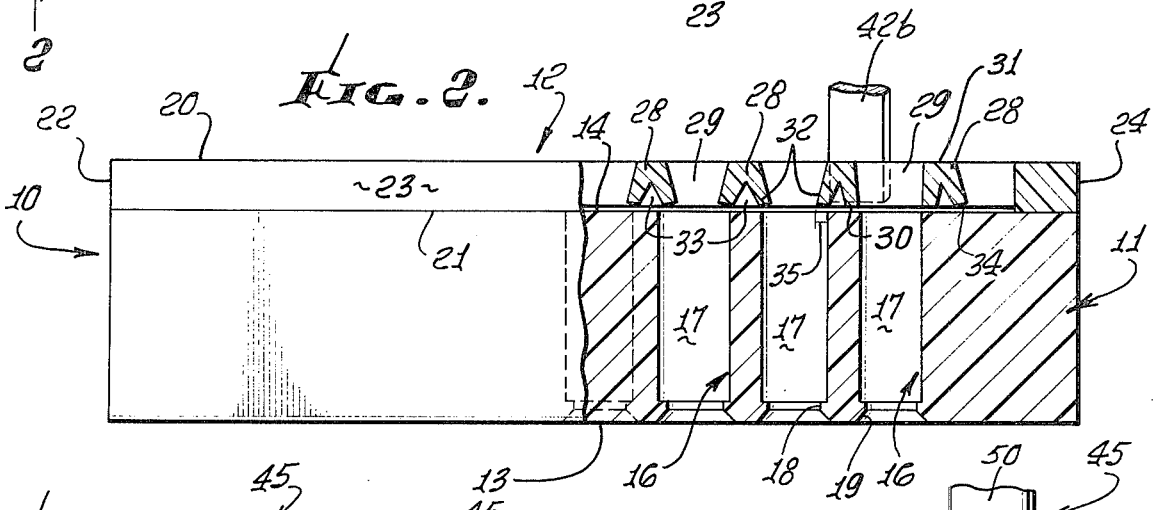
FIG. 2 is an elevational view, partially in cross section, taken along the lines 2—2 of FIG. 1.

Referring again to the drawings, in FIGS. 1 and 2 there is shown an electrical connector generally designated as 10, having an insulation member of body 11 and an electrical contact retention web or wafer 12. The insulation body has a front face 13, a rear face 14, a plurality of parallel electrical contact terminal-receiving bores 16 extending therethrough between the faces 13 and 14. The outer peripheral structure of the connector 10 has not been specifically illustrated in that it may be of any conventional form. For example, the insulation body 11 may be mounted in a rigid tubular outer shell or the body 11 may itself form the outer structure of the connector without requiring the addition of a separate outer shell.

Each of the bores 16 has a generally cylindrical electrical contact mounting section 17 providing lateral stabilization for an electrical contact member supported therein. The insulation body 11 is adapted to support electrical socket contact terminals longitudinally and accordingly the bores 16 are each provided with a constricted forward bore section 18 having a chamfered entrance ramp 19 leading to the front insulator face 13, for guiding a pin contact terminal of another connector member into mating engagement with the socket contact terminal adapted to be mounted in the bores 16.

The contact retention wafer 12 is disposed against the rear face 14 of the insulation body 11 and has a generally flat rear face 20. It has four marginal frame portions 22, 23, 24 and 25 having a continuous marginal flat front face 21 in contact with the rear face 14 of the insulation body. Internally of the margin are a series or plurality of ribs 28 arranged in rows and secured at their outer ends to marginal frame portions 23 and 25. Between each pair of ribs 28 is an elongated passage 29 extending forwardly from the rearward face 20 of the wafer to a front face 30 and inwardly of the marginal frame members. As shown in FIG. 2, each rib is spaced slightly rearwardly from the rear face 14 of the insulator to permit transverse movement with respect thereto. If the ribs are in contact with the face 14, they must be free to be moved. Each passage 29 is in register with one or more bores 16, extending in the elongated direction beyond the bores.

In FIG. 2, the ribs 28 are shown in cross section as being generally V-shaped having rear flat surfaces 31, forwardly extending walls or legs 32 and a forwardly opening V-notch 33. Each passage 29 is defined transversely by facing walls 32 extending toward each other in the forwardly direction. The end surfaces 34 of the legs are forwardly directed, almost parallel to surfaces 31, and along with other parts of the legs overlap chord segment portions of the bores 16, as indicated at 35.

Adjacent the frame portions 22 and 24, outer ribs 36 and 37 are somewhat irregular as compared with the inner ribs 28 which define symmetrical, elongated slot-shaped passages 29. Aside from the outer irregular ribs 36 and 37, each of two adjacent passage rows 29 has one of a pair of spaced ribs 28 in common.

The wafer 12 may be of one molded piece in which the marginal frame portions 22, 23, 24 and 25 and the ribs 28 are integral or the ribs and frame may be otherwise bonded together. The rib connections to the marginal frame portions may be of various shapes depending upon the resiliency of the material and the flexibility desired. In FIG. 1 the ribs are connected at their ends to the marginal frame portions 23 and 25 in rounded flared configurations 38 and 39. The connections are also rectangular, triangular or necked-down as desired to control the force required to torque, compress or otherwise spread the ribs away from the bores for entry and removal of the electrical contacts.

The wafer may be made of a tough insulation plastic material, having relatively thin walls, that is resilient and flexible so as to be relatively easily deformable. With such a material, the relatively thick marginal frame portions comprise a substantially rigid structure whereas the ribs will have the desired flexibility. The materials which have been found in practice to be particularly suitable for wafers are polyamides, such as "nylon," a fluoroethylene, such as "Kel-F" and an acetate such as "Delrin" or a polycarbonate such as "Lexan." Such materials have excellent insulation characteristics and serve to increase the dielectric separation between adjacent contacts, which is an important factor in a dense, closely spaced area of electrical contacts in small connectors. This is particularly an advantage of the present invention in that the structural arrangement of the bores and retention members are such that the space between the bores need be no greater than the insulation requirements.

The wafer may be secured to the rear face 14 of the insulator body 11 by any suitable means. Because the ribs must be movable relative to the bores, the securing must occur in the marginal frame portions 22, 23, 24 and 25. The frame portions may be bonded by a suitable cement or by fasteners such as bolts. Another means for securing the wafer to the insulator body is to support the body and the wafer in a common outer shell forming part of the connector.

FIGS. 1 and 2 illustrate a retention release, flat-bladed tool 42 similar in shape to a screwdriver blade. The tool 42*a* is shown extending in the elongated direction relative to the passages 29 in which position it has no effect on the retention means formed by the ribs. The tool 42*b* is shown in the transverse direction extending across the passage so as to have moved the resilient legs 32 of the ribs away from the bores so that an electrical contact may be inserted into, or removed from, the bores. If the ribs are flexible enough an electrical contact can be snapped into a bore without the use of a tool, the contact causing the legs 32 to move so as to not overlap the bores and to permit easy entry of the contact.

Figure 3:
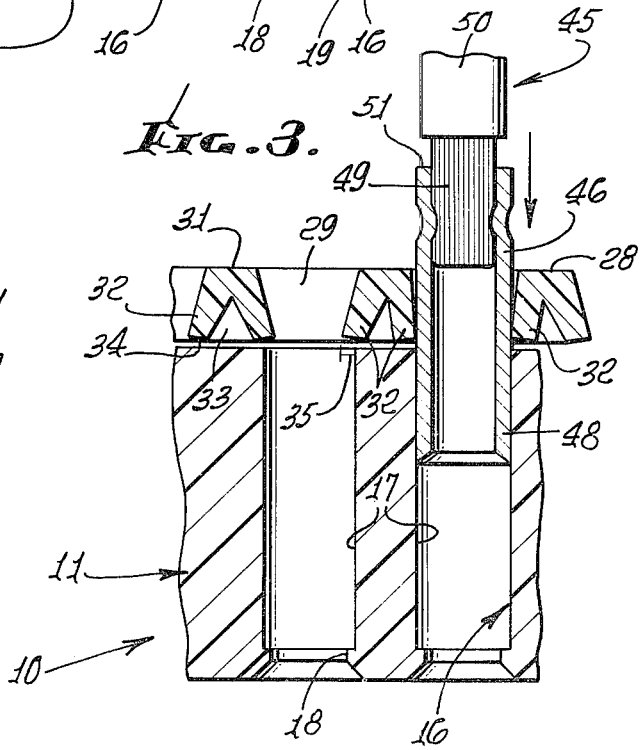
FIG. 3 is a fragmentary enlarged cross-sectional view, taken substantially along the lines 3—3 of FIG. 1.

In FIG. 3 a socket electrical contact, generally designated as 45, is shown partially inserted into a bore 16.

The electrical contact is comprised of a tubular socket contact portion 46 having a forward mounting section 48, and crimped within the tubular portion is the wire termination 49, rearwardly thereof the wire being covered by insulating material 50. A rearwardly facing shoulder 51 on the tubular socket forms the largest diameter surface on which to apply the retention means in this embodiment. The insulation material 50 is typically spaced from the socket shoulders 51, as much as 0.125 inch. On the right in FIG. 3 the resilient legs 32 of the ribs have been moved laterally away from the bore so as to permit the easy entry of the electrical contact socket therein.

Figure 4:
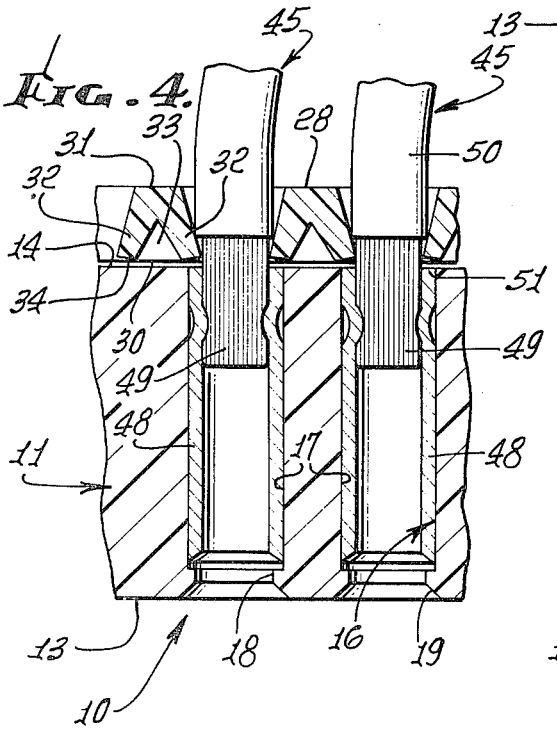
FIG. 4 is a fragmentary cross-sectional view, similar to that shown in FIG. 3, illustrating electrical contacts in the connector and the operation of the retention means.

In FIG. 4 the electrical contacts 45 have been completely inserted into the bores 16 and the legs 32 have been moved laterally from their positions on the right in FIG. 3 to overlap the bores 16 and the shoulders 51 so as to be in position to retain the contacts 45 within the connector 10. To release the retention means the tool 42 is positioned as at **42*b* in FIG. 1, the legs 32** having been moved away from the bores to free the contacts for easy removal. The contacts are fitted within the bores so they can be easily inserted and removed by hand. The ribs stabilize the contacts against rearward movement.

Figure 5:
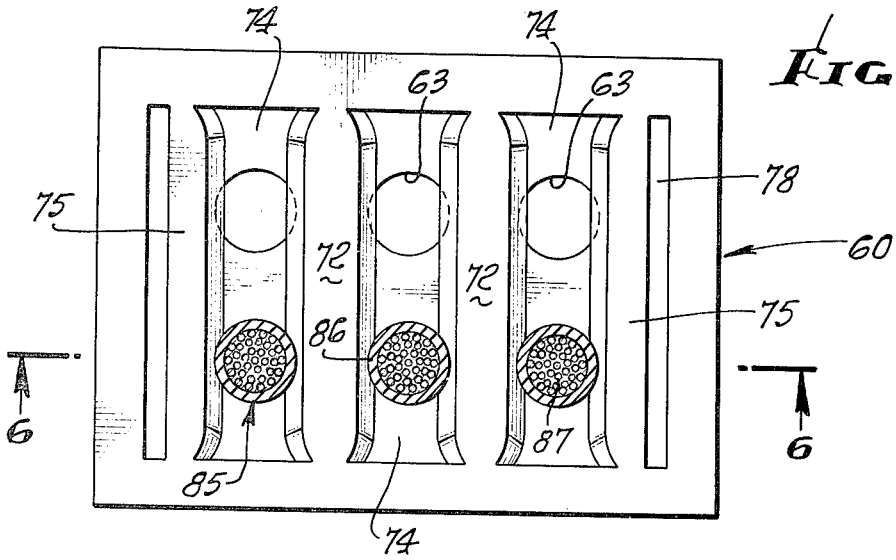
FIG. 5 is a plan view illustrating another embodiment of the invention.
Figure 6:
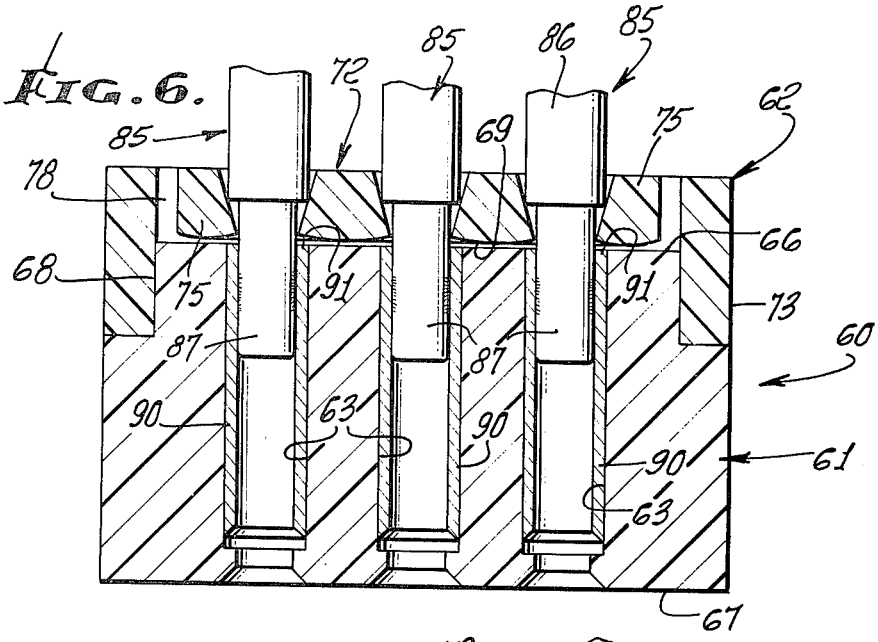
FIG. 6 is an elevational cross-sectional view taken along the line 6—6 of FIG. 5.
Figure 7:
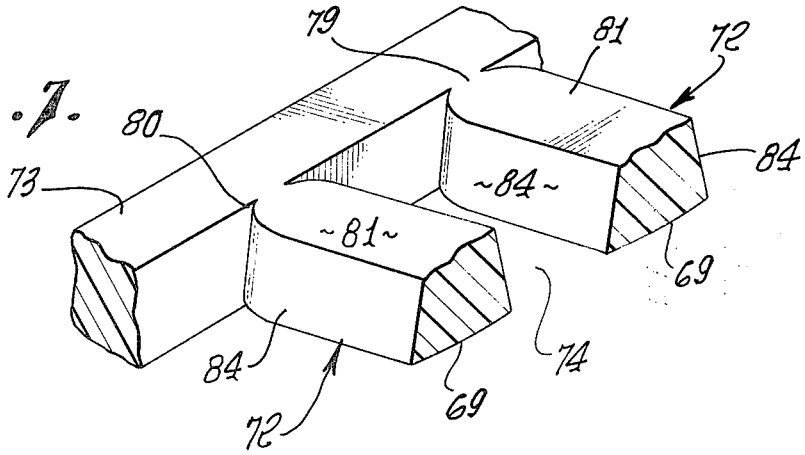
FIG. 7 is an enlarged fragmentary perspective view of the embodiment shown in FIG. 5.

In FIGS. 5, 6 and 7 there is illustrated another embodiment of the invention showing a connector, generally designated as 60, having an insulation body 61 and a retention wafer 62 secured thereto. The insulation body 61 has a plurality of bores 63 in spaced rows extending from a rearward face 66 to a forward face 67. The wafer 62 is secured at its marginal frame 73 as at 68 in FIG. 6 to the insulation body 61 and has an inward forward face formed by the curved faces 69 of spaced ribs 72, the face 69 being spaced slightly from the rearward face 66 of the insulator body for movement with respect thereto. The inner ribs 72 are integral with the frame 73 and between the ribs are formed passages 74, each in register with two bores 63. At the transverse ends outer ribs 75, also integral with the frame 73, have only an inner operational side and are spaced at 78 from the frame 73. At their ends 79, best seen in FIG. 7, the ribs are formed integrally with the frame 73 and are necked-down as at 80 to provide a flexible connection or can be straight or flared outwardly for less flexible connections. In cross section the ribs are generally trapezoidal having a rearwardly facing surface 81, spacing two diverging forwardly extending wall surfaces 84, terminating at their forward ends at the slightly curved forwardly facing surface 69.

In FIG. 6 the electrical contacts, generally designated as 85, are shown fully inserted into the bores 63. At their rearward ends the contacts have wire insulation 86 and extending therefrom is a wire termination 87 crimped within a tubular socket 90 having a rearwardly facing annular shoulder 91. The ribs have wall portions formed of the surfaces 84 and 69 overlapping parts of the bores 63 and overlapping portions of the shoulders 91 so as to be in position to retain the contacts within the connector 60. A tool 42, as shown in FIG. 1, also serves to move the rib parts away from the bores to permit the contacts to be withdrawn therefrom.

In FIG. 8 still another embodiment of the invention is shown. Portions of a connector 96 having an insulator body 97 and a wafer 98 are shown. In this embodiment bores 99 have an enlarged counterbore providing a rearwardly facing annular chamfered shoulder 102 forwardly of rearward face 103 of the insulation body.

Spaced ribs 104 of the wafer 98 form passages 105 therebetween in rows, each passage being adapted to be in register with a plurality of bores 99. In cross section the ribs 104 have a rearwardly facing surface 106, spacing two diverging forwardly extending surfaces 107 from which extend two substantially parallel surfaces 108. Extending from the termination of surfaces 108 are surfaces 109, almost parallel to the surface 106, terminating in a forwardly opening V-shaped notch 112. The rib walls or legs transversely of the notch overlap the bores 99 and the shoulders 102. The notch adds additional deformability to the resilient rib legs to permit insertion and removal of electrical contacts, generally designated as 100, having tubular socket members 113, wire insulation 101 and wire termination 110. Each tubular socket member has at its rearward end a transverse outwardly extending annular, forwardly chamfered flange 114 which fits on the shoulder 102 so as to prevent forward movement of the contact.

At the left in FIG. 8 a tubular socket member is shown to be partially inserted into a bore 99 and within a passage 105. The facing surfaces 108 of the ribs are deformed by the socket. As it is moved forwardly into the connector the flange 114 will further deform the rib walls, moving them laterally away from the bore and the shoulder 102. Whether a tool is needed for insertion of the socket depends upon the flexibility of the ribs. When the socket is fully inserted, the leg surfaces 109 and 108 extend over the socket flange 114 to releasably retain the socket within the connector. A tool 42 used to spread the rib legs apart releases the sockets.

Figure 9:
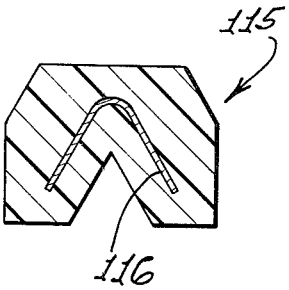
FIG. 9 is a cross section of a modified retaining rib.

In FIG. 9, there is a rib 115 in cross section, having a configuration similar to that of the ribs 104. Bonded within the rib 115 is a V-shaped leaf spring 116. The spring may extend through the full length of the rib or may be discontinuous and be positioned in portions of the rib that overlap the bores. The spring does not limit deformability but increases resiliency and retaining strength of the rib.

In FIGS. 10 and 11, a further embodiment of the invention is illustrated. In this structure, a connector, generally designated 118, is comprised of an insulation body 119 and a wafer 120 bonded thereto around its marginal edges, as at 121. The insulator body has bores 124 extending forwardly from a rearward face 130 to a rearwardly facing annular shoulder 125 from which a smaller diameter bore 126 extends through the body to a forward face 127.

As shown in FIG. 11, the bores 124, 126 are adapted to receive electrical contacts, generally designated as 132, having wire insulation 133, a wire termination connection 136 and a pin contact member 137 extending therefrom, the latter being adapted to be fitted into tubular contact sockets in another connector. Surrounding the wire insulation 133 and the wire termination connection is an insulation support ring 138, having a wall thick enough to provide a rearwardly facing annular holding shoulder 139. This insulation support 138 could be insulating tape, skrink tubing, a metal ring or a crimp in the contact.

The wafer 120 is comprised of two spacing slots 142 and 143 to provide flexibility and two rows of slotted passages 144 and 145 in which slotted portions 148 are alternated with generally circular openings 149. The openings 149 are in register with respective bores 124 and the slotted portions 148 are in alignment with the centers of the bores. The slotted portions 148 and the openings 149 extend forwardly from a rear face 150 of the wafer and therethrough to its forward face 151, spaced for relative movement with respect to the rearward face 130 of the insulation body. Each generally circular opening is defined by a pair of forwardly extending interrupted tapered or semiconical facing surfaces 154 having inner semicircular edges 153. The wafer walls forming these surfaces are resilient and will permit the insertion of an electrical contact 132 therethrough into the fully inserted position shown in FIG. 11. When so inserted the shoulder 139 on the contact is in abutment with the forward face 151 of the wafer directly forwardly of the conical surfaces 154 overlapping portions of the bore as well as parts of the shoulder.

For insertion as well as removal of the electrical contacts, the interrupted conical surfaces 154 may be moved transversely away from the bores with the aid of tools, such as 42 shown in FIG. 1, when inserted into the slotted portions 148 on both sides of a bore, the rotating of the tool causing the surfaces 154 to be moved away from the bore as well as from the shoulder 139.

The invention and its attendant advantages will be understood from the foregoing description, and it will be apparent that various changes may be made in the form, construction and arrangement of the parts of the invention without departing from the spirit and scope thereof or sacrificing its material advantages, the arrangements hereinbefore described being merely by way of example. I do not wish to be restricted to the specific forms or uses mentioned except as in the accompanying claims wherein various portions have been separated for clarity of reading and not for emphasis.

I claim:

1. In an electrical connector, an insulator member having a plurality of bores therethrough extending from a forward face to a rearward face thereof, said bores being adapted to receive respective electrical contact members therein which are insertable from the rear and each of which has surface defining a rearwardly facing shoulder, a wafer extending generally over said rearward face of said insulator member and being secured thereto, aa plurality of passages extending through said wafer;

the improvement comprising:

each passage being in register with a plurality of said bores to permit respective contact members to be inserted through the passages and into respective bores, each passage being defined by a pair of spaced ribs having ends secured within said wafer beyond said bores, said ribs having resilient portions overlapping parts of said bores and being adapted to overlap portions of said shoulders when said contact members are in said boress to releasably retain said contact members therein, and said passages and said spaced ribs being elongated.

2. The invention according to claim 1 in which:

the amount of space between said contact members when in said bores is no greater than the insulation thickness requirements of each of said contact members.

3. The invention according to claim 1 in which:

said passages and said bores are arranged in rows, said pair of spaced ribs defining each passage being comprised of resilient alternate slot-shaped portions and spaced approximately semicircular portions, said semicircular portions being in register with respective bores, said semicircular portions having conical facing surfaces extending toward each other in the forwardly direction, said conical facing surfaces terminating at forwardly facing surfaces extending generally transverse to said bores, said conical facing surfaces and said forwardly facing surfaces comprising said portions overlapping parts of said bores.

4. The invention according to claim 1 in which:

said passages are generally slot-shaped, the slots extending in the elongated direction, said ribs having facing walls extending toward each other in the forwardly direction and terminating at forwardly facing surfaces of said ribs rearwardly of said bores, the portions of said ribs overlapping parts of said bores including portions of said forwardly facing surfaces, said forwardly facing surfaces being movable laterally relative to said insulator member.

5. The invention according to claim 1 in which:

said ribs have facing walls extending toward each other in the forwardly direction and terminating at forwardly facing surfaces of said ribs rearwardly of said bores, the portions of said ribs overlapping said parts of said bores including said forwardly facing surfaces.

6. The invention according to claim 5 in which:

said portions of said ribs overlapping said parts of said bores being movable from over said bores with a tool adapted to move said resilient portions of said ribs away from each other.

7. The invention according to claim 1 in which:

said passages are arranged in adjacent rows, and each of two adjacent passage rows having one of a pair of said spaced ribs in common.

8. The invention according to claim 7 in which:

each rib cross section, transverse to the elongated direction, having a centrally positioned rearwardly facing surface, diverging surfaces extending forwardly from opposite ends of said rearwardly facing surface.

substantially parallel surfaces extending forwardly from the forward ends of said diverging surfaces, forwardly facing surfaces extending toward each other from the forward ends of said substantially parallel surfaces generally normal thereto, and said forwardly facing surfaces terminating in a forwardly opening V-shaped notch, the portions of said ribs overlapping said parts of said bores including portions of said forwardly facing surfaces and portions of said substantially parallel surfaces, said ribs adjacent their forwardly facing surfaces and their substantially parallel surfaces being resilient so as to be movable laterally away from said parts of said bores.

9. The invention according to claim 7 in which:

each pair of spaced ribs defining a passage have facing wall surfaces extending toward each other in the forwardly direction and terminating at forwardly facing surfaces of said ribs rearwardly of and adjacent said bores, the portions of said ribs overlapping said parts of said bores including portions of said forwardly facing surfaces, and said ribs adjacent their forwardly facing surfaces being resilient so as to be movable laterally away from said parts of said bores.

10. The invention according to claim 9 in which:

each rib cross section, transverse to the elongated direction, has two diverging forwardly extending surfaces spaced by a flat rearwardly facing surface, and a curved forwardly facing surface joining the forward ends of the diverging surfaces, one of said diverging surfaces defining one of said facing wall surfaces of one passage and the other defining one of said facing wall surfaces of an adjacent passage, said curved forwardly facing surface comprising said forwardly facing surfaces of said ribs rearwardly of and adjacent said bores.

11. The invention according to claim 9 in which:

each rib has a generally V-shaped cross section transverse to the elongated direction, the legs of the V being resilient and extending in the forwardly direction, one of the legs defining one of said facing wall surfaces of one passage and the other leg defining one of said facing wall surfaces of an adjacent passage.

12. The invention according to claim 11 in which:

said V-legs have said forwardly facing surfaces on their forwardly facing ends.

13. The invention according to claim 12 in which:

each rib having V-shaped cross section has bonded therein a V-shaped leaf spring having a contour generally corresponding to that of the rib.

14. In an electrical connector, an insulator member having a plurality of bores therethrough extending from a forward face to a rearward face thereof, said bores being adapted to receive respective electrical contact members therein which are insertable from the rear and each of which has surface defining a rearwardly facing shoulder, a wafer extending generally over said rearward face of said insulator member and being secured thereto, one passage extending through said wafer; the improvement comprising:

said passage being in register with a plurality of said bores to permit respective contact members to be inserted through the passage and into respective bores, said passage being defined by a pair of spaced ribs having ends secured within said wafer beyond said bores, said ribs having resilient portions overlapping parts of said bores and being adapted to overlap portions of said shoulders when said contact members are in said bores to releasably retain said contact members therein, and said passage and said spaced ribs being elongated.

* * * * *